United States Patent [19]

McBride

[11] 4,406,424

[45] Sep. 27, 1983

[54] QUICK THREADING BALL TENSION CONTROL

[76] Inventor: Edward J. McBride, P.O. Box 44, Long Pond, Pa. 18334

[21] Appl. No.: 407,000

[22] Filed: Aug. 11, 1982

[51] Int. Cl.³ ..... B65H 59/22

[52] U.S. Cl. ..... 242/152.1

[58] Field of Search ..... 242/152.1, 151, 152, 242/147 R, 149; 226/195

[56] References Cited

U.S. PATENT DOCUMENTS

| | | | |
|---|---|---|---|
| 3,874,613 | 4/1975 | Zollinger | 242/152.1 |
| 4,017,038 | 4/1977 | Paepke | 242/152.1 |
| 4,019,701 | 4/1977 | McCullough | 242/152.1 |
| 4,030,684 | 6/1977 | Levin | 242/152.1 |
| 4,083,514 | 4/1978 | Levin | 242/152.1 |
| 4,094,477 | 6/1978 | McBride, Jr. | 242/152.1 |

*Primary Examiner*—Stanley N. Gilreath

*Attorney, Agent, or Firm*—Karl L. Spivak

[57] ABSTRACT

A ball type yarn tensioning device is disclosed which includes in side by side juxtaposition a ball chamber and a threading chamber. An elongated, vertical aperture is provided between the two chambers to permit the passing therethrough of a yarn threading instrument for threading purposes. After the yarn tensioning device is threaded, the yarn will follow an inclined path from the bottom of the ball chamber, through the aperture and out of the top of the threading chamber. The ball chamber terminates downwardly in a bottom insert which provides a seat for a ball within the ball chamber for yarn tensioning. The threading chamber terminates upwardly in a top insert to resist abrasion by a running yarn. Preferably, the threading chamber is downwardly open to permit lint and other debris to continuously drop from the device in an unobstructed manner.

15 Claims, 4 Drawing Figures

QUICK THREADING BALL TENSION CONTROL

BACKGROUND OF THE INVENTION

The present invention relates generally to the field of ball type yarn tension devices, and more particularly, is directed to a vertical ball tension control incorporating improved threading means.

Prior workers in the art have developed various types of yarn tensioning devices which include a vertical passageway or channel within which are positioned a plurality of balls. The channel terminates downwardly in a ceramic insert upon which the lowermost of the balls seats for yarn tensioning purposes. The yarn is tensioned by the action of the lowermost ball in known manner by squeezing the yarn against the seat as the yarn is fed through the tensioning device. Examples of such prior art ball tensioning devices are shown and described in U.S. Pat. Nos. 3,753,535 to Zollinger and in 4,030,684 to Levin.

As disclosed in the said patents, the prior art yarn tensioning devices include a housing which defines a cylindrically shaped, vertically oriented yarn passageway. The yarn passageway is downwardly defined at the lower end thereof by a ceramic yarn eye insert which provides a seat for the lowermost ball within the passageway so that the ball normally remains seated at the top of the insert. Usually, a threading device, such as latchless knitting needle is inserted through the yarn passageway and through the ceramic insert by displacing the balls as necessary to pull the yarn through the device. Threading the prior art ball tension devices has usually presented problems because the physical size of the balls and the restricted diameter of the ball chamber have usually rendered it impossible to thread the device in a single pass with a straight threading instrument. Once the yarn is properly threaded for feeding to a weaving, knitting or other similar yarn employing machine, the ball will then return automatically to its seat for yarn tensioning in the usual manner.

In the case of heavy yarns, for example yarns suitable for use with carpets, it is presently the practice to provide ball tension devices of similar configuration, which devices are fabricated of increased dimensions and which utilize larger and heavier balls. The use of such heavy balls renders these presently available yarn tensioning devices relatively more difficult to thread. Additionally, many of the heavy yarns utilized with the large ball tension devices produce excessive quantities of lint when passing through the device, which lint tends to collect within the yarn passageway to thereby impede the function of the balls or to otherwise build up on the inner surfaces of the yarn passageway.

SUMMARY OF THE INVENTION

The present invention relates generally to the field of yarn tensioning devices, and more particularly, is directed to a ball tension control incuding means to allow quick threading and means to prevent the build up of lint within the device.

The ball tension control of the present invention is fabricated to include a generally cylindrical, vertically oriented body which defines therein a vertical ball chamber for receiving therein of one or more steel balls for yarn tensioning purposes. The ball chamber is upwardly open to facilitate placing or removing balls within the ball chamber. The ball chamber terminates downwardly in a flange to receive a ceramic insert, which insert serves as a seat for the lowermost of the said steel balls. The ceramic insert defines a yarn opening and a seat whereby yarn passing through the yarn opening will be tensioned by the lowermost of the steel balls as it rests upon the seat.

A yarn passageway or threading chamber preferably integrally extends in lateral relationship from the ball chamber and includes a bottom opening for passage of lint therethrough to prevent lint build-up within the device. The yarn passageway or threading chamber is upwardly provided with a ceramic insert in known manner for yarn guiding purposes. A vertical, elongated aperture is provided between the vertical ball chamber and the adjacent threading chamber, which aperture is elongated sufficiently to provide an inclined yarn path through the device as the yarn passes between the seat of the ball chamber ceramic insert and the opening defined in the threading chamber top ceramic insert.

It is noteworthy that the yarn does not pass vertically through the ball chamber after having yarn tension applied at the ball seat junction between the ball and the bottom ceramic insert, but rather, the yarn passes in an inclined path of travel through the vertical aperture and thence travels through the adjacent yarn passage or threading chamber, in a straight line extension of the inclined path. As above set forth, the threading chamber is constructed to be open at the bottom whereby any lint, dirt, or other foreign matter which might fall off of the yarn as it passes through the device will drop out of the open bottom of the threading chamber.

The offset yarn passageway through the device provides a convenient passage for a threading tool whereby the unit can be easily threaded in single stroke, even when there is little clearance between the balls and the inner periphery of the ball chamber. In use, a straight threading instrument can be fed downwardly through the top ceramic insert in the threading chamber in inclined alignment, through the aperture between the threading chamber and the ball chamber and through the opening defined by the ceramic insert positioned at the bottom of the ball chamber by uring the balls laterally sufficiently to permit the threading instrument to pass through the device in a single stroke. The laterally offset position of the threading chamber from the ball chamber provides for a simple, quick and easily threaded ball tension control device.

It is therefore an object of the present invention to provide an improved ball tension control of the type set forth.

It is another object of the present invention to provide a novel ball tension control that incorporates a vertical ball chamber and a vertical threading chamber in side by side relationship with an elongated vertical aperture therebetween to define an inclined yarn path through the device and to permit passage of threading instrument completely through the device in a single stroke.

It is another object of the present invention to provide a novel quick threading ball tension control including a ball chamber and a threading chamber in side by side juxtaposition and having a vertical aperture therebetween, the threading chamber being downwardly open to permit lint and other debris to drop out of the bottom opening to prevent any lint accumulation within the device.

It is another object of the present invention to provide a novel quick threading ball tension control including a vertically oriented ball chamber having a ball seat therein, a laterally offset yarn chamber having an unrestricted bottom opening therefrom, and means to provide an inclined yarn path through the device, which means can accommodate a straight threading tool to allow the unit to be easily threaded in single stroke.

It is another object of the present invention to provide a novel quick threading ball tension control that is simple in design, rugged in construction and trouble-free when in use.

Other objects and a fuller understanding of the invention will be had by referring to the following description and claims of a preferred embodiment, taken in conjunction with the accompanying drawings, wherein like reference characters refer to similar parts throughout the several views and in which:

DESCRIPTION OF THE PREFERRED EMBODIMENT OF THE INVENTION

Figure 1:
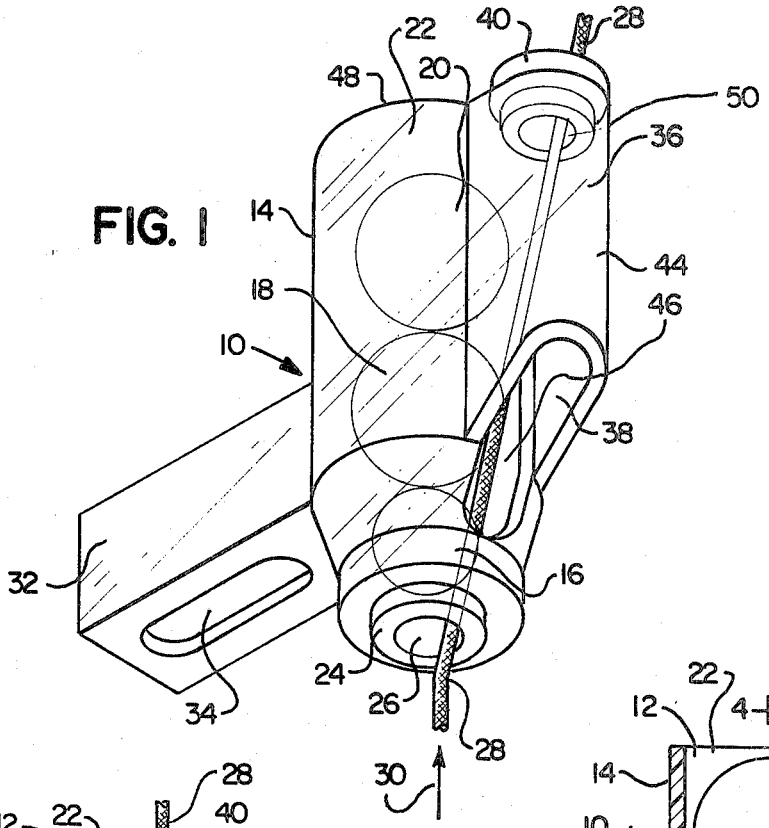
FIG. 1 is perspective view, partially broken away, showing a quick threading ball tension control which is constructed in accordance with the teachings of the present invention.

Although specific terms are used in the following description for the sake of clarity, these terms are intended to refer only to the particular structure of the invention selected for illustration in the drawings, and are not intended to define or limit the scope of the invention.

Figure 2:
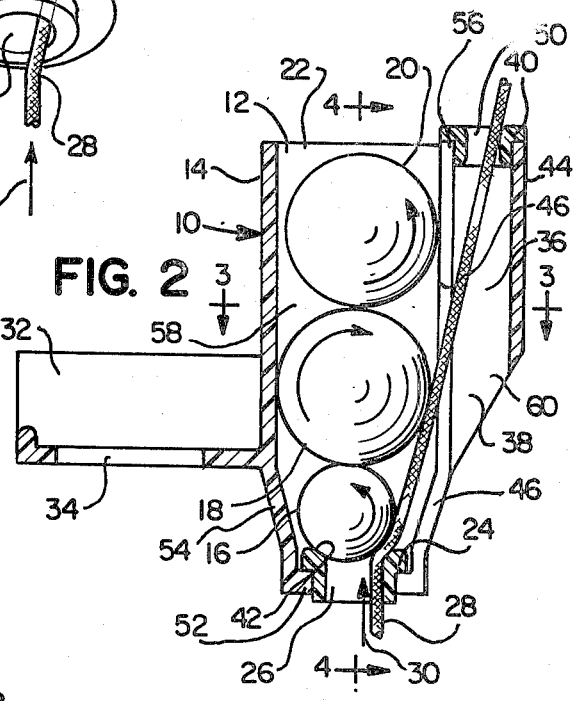
FIG. 2 is vertical cross-sectional view taken through the device of FIG. 1.

Referring now to the drawings, FIGS. 1 and 2, the ball tension control of the present invention is indicated generally at 10 and is oriented in the vertical, upright position in the orientation intended for use. The ball tension control may be employed in known manner in conjunction with the operation of any known type of machine with which running yarns are used, for example, knitting machines, weaving machines, and the like.

The ball tension control of the present invention includes a generally cylindrical housing or body 14 which defines a vertical ball chamber 12 for retaining a plurality of steel balls 16, 18, 20 therein in vertically stacked arrangement as illustrated. Preferably, the device is fabricated of molded clear plastic having suitable strength and rigidity for the application, in known manner. The vertical ball chamber 12 terminates upwardly in an open top 22 whereby balls may be either added or removed from the ball chamber 12 in a relatively easy operation. The ball chamber is downwardly constricted in known manner to form a generally frusto-conical configuration 54 including a bottom flange 52.

A ceramic yarn eye insert 24 defines an uninterrupted yarn passageway 26 therethrough and is bottomly secured within the vertical ball chamber 12 by resting upon the bottom flange 52. If desired, the ceramic insert 24 may be cemented in known manner to the flange 52 or may simply be a press fit therein in a manner to prevent disassociation of the parts. The frusto-conical bottom portion 54 of the ball chamber 12 functions to guide the lowermost ball 16 toward the ceramic insert 24 whereby the ball will normally always tend to rest upon the seat 42 under all conditions of use. Preferably, as illustrated, the lowermost ball 16 is smaller in diameter than the upper balls 18, 20 whereby the lowermost ball 16 can readily seat upon the ceramic insert as guided by the conical shape of the lower frusto-conical ball chamber portion 54. In will be appreciated that in some designs, it may advantageous to construct the ball chamber in a cylindrical configuration with cylindrical interior sidewalls of uniform diameter wherein the diameter of the ball chamber will be the same throughout its height. Under such circumstances, all of the balls positioned within the ball chamber would then optimumly be of the same size and would still function in the same manner as hereinafter described.

Still referring to FIGS. 1 and 2, a yarn passage chamber or threading chamber 36 is positioned in side by side relationship with the ball chamber 12 and preferrably may be integrally formed therewith. The chamber 36 is generally cylindrically formed preferably and as illustrated, is downwardly defined by an open bottom 38. The bottom 38 is completely open and unencumbered whereby lint, dirt, debris and other unwanted materials carried by the yarn 28 can freely exit the device 10 by gravity, thereby eliminating any tendency to clog in and about the balls or within the interior of the device 10. A top ceramic yarn eye insert 40 seats upon the top 56 of the threading chamber sidewalls and is secured therein in known manner, for example by employing a suitable cement. The top ceramic insert 40 defines a yarn passageway 50 therethrough for passage of the tensioned yarn to the knitting or weaving machine (not shown). It is noteworthy that the axis of the top insert 40 at the top of the threading chamber 36 is laterally offset from the axis of the bottom ceramic yarn insert 24 which is positioned at the lower end of the ball chamber 12.

Figure 4:
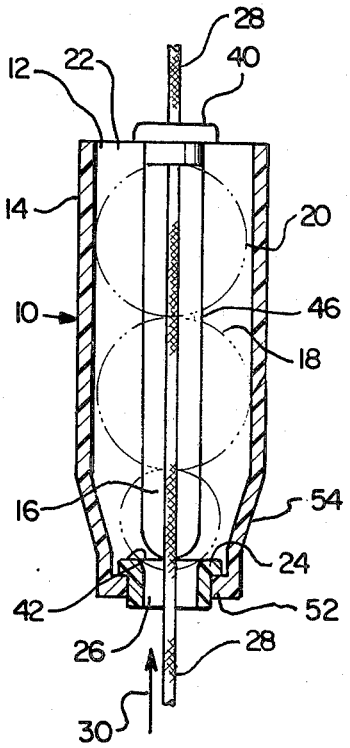
FIG. 4 is a cross-sectional view taken along line 4—4 on FIG. 2, looking in the direction of the arrows.
Figure 3:
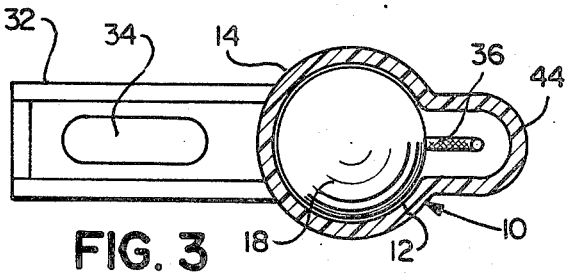
FIG. 3 is a cross-sectional view taken along line 3—3 on FIG. 2, looking in the direction of the arrows.

As best seen in FIGS. 1, 2 and 4, the ball chamber sidewall 14 is provided with an enlongated, vertically oriented aperture 46, which aperture permits the interior 58 of the vertical ball chamber 12 to communicate directly with interior 60 of the yarn passage chamber or threading chamber 36. Accordingly, as illustrated in FIG. 2, the yarn 28, after being tensioned by the interaction of the lowermost ball 16 and the ceramic seat 42, follows an inclined path through the ball tension control 10 from the seat 42 of the ceramic eye insert 24, through a lower portion of the ball chamber interior 58, through the vertically aligned aperture 46, through an upper portion of the yarn passage chamber interior 60 and through the yarn opening 50 which is defined in the top yarn ceramic eye insert 40. For threading purposes, as hereinafter more fully set forth, a threading device such as a latchless knitting needle, (not shown) can follow the same course or path through the device as indicated for the yarn, for threading purposes. When threading, the lowermost ball 16 will be urged off of the seat 42 sufficiently to allow the threading device to position entirely through the tension control 10 in a single pass.

In conventional manner, a mounting bracket is integrally molded with or is securely affixed to the ball chamber sidewall 14 and extends at substantially right angles to the vertical axis through the ball chamber 12. Preferably, the mounting bracket 32 is provided with an elongated slot or opening 34 to facilitate positioning the ball tension control 10 in conventional manner upon the machine (not illustrated) with which it is to be used.

The ball or balls 16, 18, 20 employed for use with the ball tension control 10 are preferably fabricated of hardened stainless steel of predetermined weight and predetermined diameter relative to the diameter of the ball chamber 12 and the frusto-conical lower portion 54. The total weight of the balls is selected to apply the desired amount of tension to the yarn 28 as it passes from its source upwardly through the yarn opening 26 and between the seat 42 of the insert 24 and the lowermost ball 16 which rests upon and applies tension to the running yarn. As best seen in FIGS. 1 and 2, the yarn 28 passes about the ball 16 and the follows a path that is inclined from the vertical and passes through the elongated aperture 46. The yarn 28 exits the device through the opening 50 which is defined within the top ceramic insert 40. The diameter of the lowermost ball 16 may vary within limits so long as it is sufficiently large in diameter to rest upon the seat 42. The ball 16 should have a diameter that is sufficiently less than the diameter of the ball channel at the smallest diameter of the frusto-conical area 54 so that the interior surface of the ball chamber adjacent to the seat 42 will sufficiently restrain lateral movements of the ball whereby the forces of gravity, acting upon the ball, will cause the lowermost ball 16 to remain seated atop the bottom ceramic insert 24. A sufficient number of balls 18, 20 can be provided as may be desired to adjust the tension upon the yarn 28 at the seat 42.

The device is provided with quick threading construction means by positioning the upper or top ceramic insert 40 in the threading chamber 36 in laterally offset relationship to the bottom ceramic insert 24 of the ball chamber 14 whereby a relatively thin, elongated instrument having a hook at one end (not illustrated), such as a latchless knitting needle may be employed for threading purposes. Referring specifically to the position of the yarn 28 illustrated in FIG. 2, the threading instrument can be applied downwardly through the aligned openings 50 in the top ceramic insert 40, the intermediate vertical aperture 46 and the opening 26 defined by the lower ceramic insert 24 in a single pass by urging the lowermost ball 16 off of its seat with the latchless knitting needle. With the instrument inserted along the general path prescribed by the yarn 28 in FIG. 2, its hook can then engage the yarn 28. The instrument can be drawn upwardly along the same angularly inclined path illustrated by the yarn. As the instrument is withdrawn upwardly, it will function to pull the yarn through the bottom yarn eye insert opening 26, through the elongated vertical aperture 46 and through the opening 50 defined by the top ceramic insert 40, thereby easily threading the device in a single pass.

After the threading instrument is withdrawn from its threading position within the lower insert opening 26, the lowermost ball 16 will automatically by gravity return to its position upon the seat 42 of the insert 24. It will be appreciated that the vertical aperture 46 should be wide enough to permit unobstructed passage of the yarn 28 and the threading instrument (not illustrated) without binding, but should be not sufficiently large enough to allow a ball 16, 18 or 20 to pass therethrough. In this manner, the presence of the elongated apperture 46 will not in any way interfere with the function of the balls 16, 18, 20 or the ball chamber 12.

Although the present invention has been described with a certain degree of particularity, it is understood that the present disclosure has been made only by way of example and that numerous changes in the details of construction and the combination and arrangement of parts may be resorted to without departing from the spirit and scope of the invention.

What is claimed is:

1. A yarn tensioning device of the type including one or more stacked balls comprising a housing, said housing having a sidewall defining a ball chamber of predetermined length, the ball chamber terminating downwardly in a bottom hardened insert upon which the lowermost of said balls rests for yarn tensioning purposes, the bottom insert defining an opening therethrough for passage of the yarn;

a contiguous threading chamber affixed to the ball chamber and being positioned adjacent thereto, the threading chamber having a sidewall defining a yarn passage channel, the threading chamber being provided with a top opening for passage of the yarn therethrough; and an aperture in the said housing sidewall, the aperture extending at least part of the distance between the ball chamber top and the bottom insert to permit yarn to pass therethrough, the ball chamber communicating with the yarn passage channel through the said aperture.

2. The yarn tensioning device of claim 1 wherein the opening through the bottom hardened insert, the top opening of the threading chamber and the housing sidewall aperture align in a straight line and whereby a threading instrument can be inserted through the three openings in a single pass.

3. The yarn tensioning device of claim 2 wherein the ball chamber has a longitudinal axis and the straight line is inclined from the said axis.

4. The yarn tensioning device of claim 1 wherein the ball chamber terminates upwardly in an open top to permit adding balls into or removing balls from the ball chamber.

5. The yarn tensioning device of claim 1 wherein the ball chamber comprises a cylindrical upper portion and a unitary frusto-conical shaped lower portion, the bottom hardened insert being secured at the lower end of the frusto-conical shaped lower portion.

6. The yarn tensioning device of claim 1 wherein a top hardened insert is positioned at the top opening of the threading chamber, the top hardened insert being contacted by the yarn as it passes through the device.

7. The yarn tensioning device of claim 6 wherein the top hardened insert defines an opening therethrough, the yarn passing through the insert opening.

8. The yarn tensioning device of claim 7 wherein the bottom insert opening, the top insert opening and the aperture in the housing sidewall align to define a straight line, whereby a yarn threading instrument can be inserted through the device along the straight line for yarn threading purposes.

9. The yarn tensioning device of claim 8 wherein the threading chamber is open and unobstructed below the top insert opening whereby any loose materials that may be carried by the yarn can fall from the device by gravity.

10. The yarn tensioning device of claim 8 wherein the ball chamber has a longitudinal axis and wherein the said straight line is angularly inclined from the longitudinal axis.

11. The yarn tensioning device of claim 7 wherein the bottom insert opening and the top insert opening are of similar size.

12. The yarn tensioning device of claim 1 wherein the aperture extends from the ball chamber top downwardly to the bottom insert.

13. The yarn tensioning device of claim 6 or claim 12 wherein the aperture extends upwardly to the top insert in the threading chamber.

14. The yarn tensioning device of claim 1 wherein the threading chamber is generally cylindrically shaped and is of uniform diameter throughout its length.

15. The yarn tensioning device of claim 14 wherein the threading chamber is open and unobstructed below the said top opening.

* * * * *